US007282022B2

(12) United States Patent
Falk et al.

(10) Patent No.: US 7,282,022 B2
(45) **Date of Patent: *Oct. 16, 2007**

(54) INFANT CARE APPARATUS WITH FIXED OVERHEAD HEATER

(75) Inventors: Steven M. Falk, Baltimore, MD (US); Matthew L. Severns, Gaithersburg, MD (US); Joseph Boris, Cockeysville, MD (US); Michael H. Mackin, Ellicott City, MD (US); Christopher A. Dykes, Columbia, MD (US)

(73) Assignee: General Electric Co, Schenectady, NY (US)

( * ) Notice: Subject to any disclaimer, the term of this patent is extended or adjusted under 35 U.S.C. 154(b) by 772 days.

This patent is subject to a terminal disclaimer.

(21) Appl. No.: 10/672,948

(22) Filed: Sep. 26, 2003

(65) Prior Publication Data

US 2005/0070756 A1 Mar. 31, 2005

(51) Int. Cl.
*A61G 11/00* (2006.01)

(52) U.S. Cl. ..... 600/22

(58) Field of Classification Search ..... 600/21, 600/22; 128/205.26, 897, 898; 5/600, 603
See application file for complete search history.

(56) References Cited

U.S. PATENT DOCUMENTS 3,858,570 A 1/1975 Beld et al.
4,750,474 A 6/1988 Dukhan et al.
4,936,824 A 6/1990 Koch et al.
5,474,517 A 12/1995 Falk et al.
6,022,310 A 2/2000 Goldberg et al.
6,213,935 B1 4/2001 Mackin et al.
6,224,539 B1 5/2001 Jones et al.
6,709,384 B1 3/2004 Donnely et al.
6,953,427 B1 * 10/2005 Mackin et al. ..... 600/22

FOREIGN PATENT DOCUMENTS

WO WO03/030797 A 4/2003

OTHER PUBLICATIONS

J. Lemburg and J. Koch; Future Development of Medical Technology in Pediatrics II; Dragerwerk AG, Lubeck, DE; 1991; pp. 2, 168-170 with unofficial translation.

* cited by examiner

*Primary Examiner*—Samuel G Gilbert
(74) *Attorney, Agent, or Firm*—Roger M. Rathbun

(57) ABSTRACT

An infant care apparatus having a canopy movable with respect to an infant support for supporting an infant between a lower position enclosing the infant in an infant compartment and an upper position opening the infant compartment. The canopy has an opening and a door that can be closed to block the opening and opened to unblock the opening. A radiant heater is located in a fixed position above the infant support to direct infrared energy toward the infant support. When the canopy is in its lower position, a convective heating system warms the infant compartment. The door either closes as the canopy moves to its lower position or opens as the canopy moves to its upper position.

23 Claims, 12 Drawing Sheets

INFANT CARE APPARATUS WITH FIXED OVERHEAD HEATER

BACKGROUND

The present invention relates to an infant warming apparatus and, more particularly, to an apparatus for providing the functions of an infant incubator and an infant warmer and which includes a convective heating system and a separately controlled overhead fixed radiant heater.

There are, of course, many devices or apparatus for the warming of an infant and to supply the necessary heat to maintain the infant at a predetermined temperature. Of the various apparatus, there are infant warmers that are basically planar surfaces on which the infant is positioned and which planar surfaces generally include side guards to keep the infant safely within the confines of the apparatus.

Infant warmers normally have an overhead radiant heater that is located above the infant and which thus radiates energy in the infrared spectrum to impinge upon the infant to maintain the infant at a warm, desired temperature. Since the infant is otherwise totally exposed to the surroundings, there is almost unlimited access to the infant by the attending personnel to perform various procedures on that infant. An example of an infant warmer is shown and described in U.S. Pat. No. 5,474,517 of Falk et al as prior art to that patent.

There are also infant incubators and which are more confined enclosures that contain the infant within an enclosed controlled atmosphere in an infant compartment that provides heat to the infant and also may provide control of humidity in the enclosed environment. Such incubators maintain the infant for long periods of time and include handholes to access the infant. Generally, there is, in addition, one or more doors that can be opened to access the infant or to insert or remove the infant to and from the incubator. Such devices provide a good atmosphere to the infant and control that local environment within which the infant is located, however, it is sometime difficult to perform a wide variety of procedures on the infant due to the somewhat limited access to that infant. An example of an infant incubator is shown and described in U.S. Pat. No. 4,936,824 of Koch et al.

At the present, there are also certain infant care apparatus that have both of the aforedescribed functions, that is, the apparatus can operate either as a radiant warmer or an incubator and one such apparatus is shown and described in U.S. Pat. No. 6,213,935 and entitled "Infant Warming Apparatus" of Mackin et al and assigned to the assignee of the present application. In the Mackin et al patent, the apparatus has a canopy with a radiant heater and the canopy and radiant heater can be moved between an upper position where the radiant heater directs the energy in the infrared spectrum towards the infant to provide heat to the infant and a lower position where the radiant heater is disabled and a convective heating system is provided in the infant apparatus to heat the infant now enclosed within an infant compartment and covered by the canopy.

An infant apparatus is also shown and described in U.S. Pat. No. 6,224,539 of Jones et al, and assigned to the assignee of the present application. In the Jones et al patent, there is canopy having a radiant heater positioned over an infant support and, again the canopy and the radiant heater can be raised and lowered between upper and lower positions where the radiant heater is energized when in the upper position and the convective system provides the heat to the infant when the canopy and radiant heater are in the lower position. There are also a set of doors in the Jones et al patent that are opened and closed to allow the heater to radiate outwardly and to enclose the heater in a protective environment when the radiant heater has been inactivated.

Thus, in the operation of the Jones et al apparatus, as the canopy and heater descend toward the infant in converting the apparatus from a radiant warmer function to an incubator function, the doors are automatically closed to retain the heater in that protective environment and, conversely, as the canopy and the radiant heater are again raised to convert from an incubator function to an infant warmer function, the doors are automatically opened so that the radiant energy can emanate from the heater, when energized, toward the infant resting on the infant platform.

There has also been disclosed another infant apparatus that utilizes both the functions of an infant incubator and an infant warmer and is described in a printed publication of Dragerwerk AG in 1991, where an apparatus is disclosed having a hood that can be raised and lowered. When the hood of that publication is lifted to an open position with respect to the infant platform to afford access to the infant, a radiant heater in the configuration of a horseshoe shape can be energized.

Finally, in U.S. Pat. No. 4,750,474 of Dukham et al, there also is described an infant apparatus that utilizes a convective heater system generally located beneath the infant platform and which is energized when the apparatus is closed and is operating as an incubator. There is a canopy that can be opened by rotating two canopy halves downwardly to open up the infant compartment and a radiant heater can then supply radiant energy onto the infant.

Accordingly, it would be advantageous to have an infant apparatus that selectively incorporates the better features of the aforementioned differing apparatus by having a fixed heater that is positioned above the infant platform on which the infant rests to direct radiant energy toward the infant when the apparatus is functioning as an infant warmer while also have a movable canopy that can move between a closed position where it encloses and forms an infant compartment warmed by a convective heating system and an upper position where the caregiver has complete access to the infant and the apparatus is operating in the infant warmer function.

It would also be advantageous in such infant apparatus that there be some means to transmit the radiant energy efficiently from the radiant heater despite the presence of the canopy that is movable over the infant platform without having the canopy impede the transmission of the radiant energy from the radiant heater to the infant.

SUMMARY OF THE INVENTION

Accordingly, the present invention relates to an infant care apparatus that has an overhead canopy that can be raised and lowered by the user with respect to an infant platform between an upper and a lower position. In the lower position the canopy interacts with the infant platform to contain the infant beneath the canopy and a convective heating system can be employed to provide heat to the infant while, in the upper position, the infant is fully accessible and can be attended to by the caregiver.

A radiant heater is located in a fixed position above the infant platform and is situated so as to direct the infrared radiation along a path to impinge that infrared radiation on to the infant platform. The canopy has an opening therein, generally centrally located in the canopy, and which opening is positioned and dimensioned so as to allow the infrared energy to continue along the path to the infant support when the canopy is in its upper position.

In the preferred embodiment, there is at least one door located in the upper portion of the canopy and which door can be moved between a closed position where the door blocks the opening and an open position where the opening is not blocked. The door is in its closed position when the canopy is in its lower position and the door is open when the canopy is in its upper position. Thus, the canopy can be used to contain the infant within an infant compartment and be vertically movable between and upper position and a lower position, however when the canopy is in its upper position, the radiant heater can be energized wherein the presence of the canopy does not impede the transmission of the infrared energy from the radiant heater directly toward the infant.

The door can be biased toward its closed position or its open position depending upon the particular embodiment, that is, when the door is biased toward its open position, the door is closed against that bias as it reaches its lower position whereupon when the door is biased toward its closed position, the door is opened against that bias as it moves upwardly toward its upper position.

In either instance the opening or closing of the door is carried out by the canopy moving with respect to a fixed structural component such that there is an interaction between that fixed structural component that physically contacts the door or a component affixed to the door and the relative motion of the canopy causes the door to move to the desired position countering the bias.

Thus, one means of opening the door is to have the canopy, as it travels in the upward direction, to encounter and abut against the fixed component. As such, the further travel of the canopy in the upward direction causes the fixed component to push downwardly on the door and move it against the bias to the open position.

Similarly, another means of opening the door is to have the canopy, as it travels in the downward direction, to encounter a fixed structural component. As the canopy travels further downwardly, that fixed component acts against a bracket or other extension affixed to the door and the further movement of the canopy in the downward direction pushes the door to its closed position.

In carrying out the present invention, there is a base with a vertical frame member extending upwardly from the base and an infant platform mounted to the vertical frame member above the base. The upper surface of the infant platform is a flat, planar surface that is adapted to underlie and support an infant being cared for in the use of the apparatus. Extending upwardly from the infant platform are walls of a transparent material and the vertically movable canopy is movable between a lower position where it mates with the upper edges of the walls to form therein an infant compartment and an upper position where the flat planar surface of the infant platform is generally open to the ambient atmosphere for full access to an infant supported by the infant platform.

The radiant heater is mounted between a pair of vertical frame members such that the radiant heater is generally located above the head of an infant positioned on the infant support and the radiant energy from the radiant heater is emitted toward the infant to provide warmth to the infant when the canopy is in its upper position. A convective heating system is also provided to supply heated air to the infant compartment for warming the infant contained therein when the canopy is in its lower position. In the preferred embodiment, the convective heating system is contained within the infant support underneath the flat, planar surface supporting the infant. The convective heat system includes a heater, a fan and the various ducting and passageways used to convey the air to and from the infant compartment.

A lifting system is provided to raise and lower the canopy between the upper and lower positions. The lifting system can be the system shown and described in U.S. Pat. No. 6,231,499 of Thomas C. Jones and entitled "Lift Mechanism For Infant Apparatus Canopy" and in that patent the lifting system is used to provide vertical movement to both a radiant heater and a canopy. A control system is also utilized such that the convective heating system is activated when the canopy is in its lower position and the radiant heater is disabled and, conversely, when the canopy is in its upper position, the radiant heater is activated and the convective heating system is disabled and such control system is shown and described in U.S. Pat. No. 6,213,935 of Mackin et al and entitled "Infant Warming System" and the disclosures of both of the aforementioned U.S. patents are hereby incorporated herein by reference. Alternatively, there could be a control system where the radiant heater is left on when the infant care apparatus is acting as an incubator or the convective heating system remain on when the infant care apparatus is acting as a radiant warmer.

These and other features and advantages of the present invention will become more readily apparent during the following detailed description taken in conjunction with the drawings herein.

DETAILED DESCRIPTION OF THE INVENTION

Figure 1:
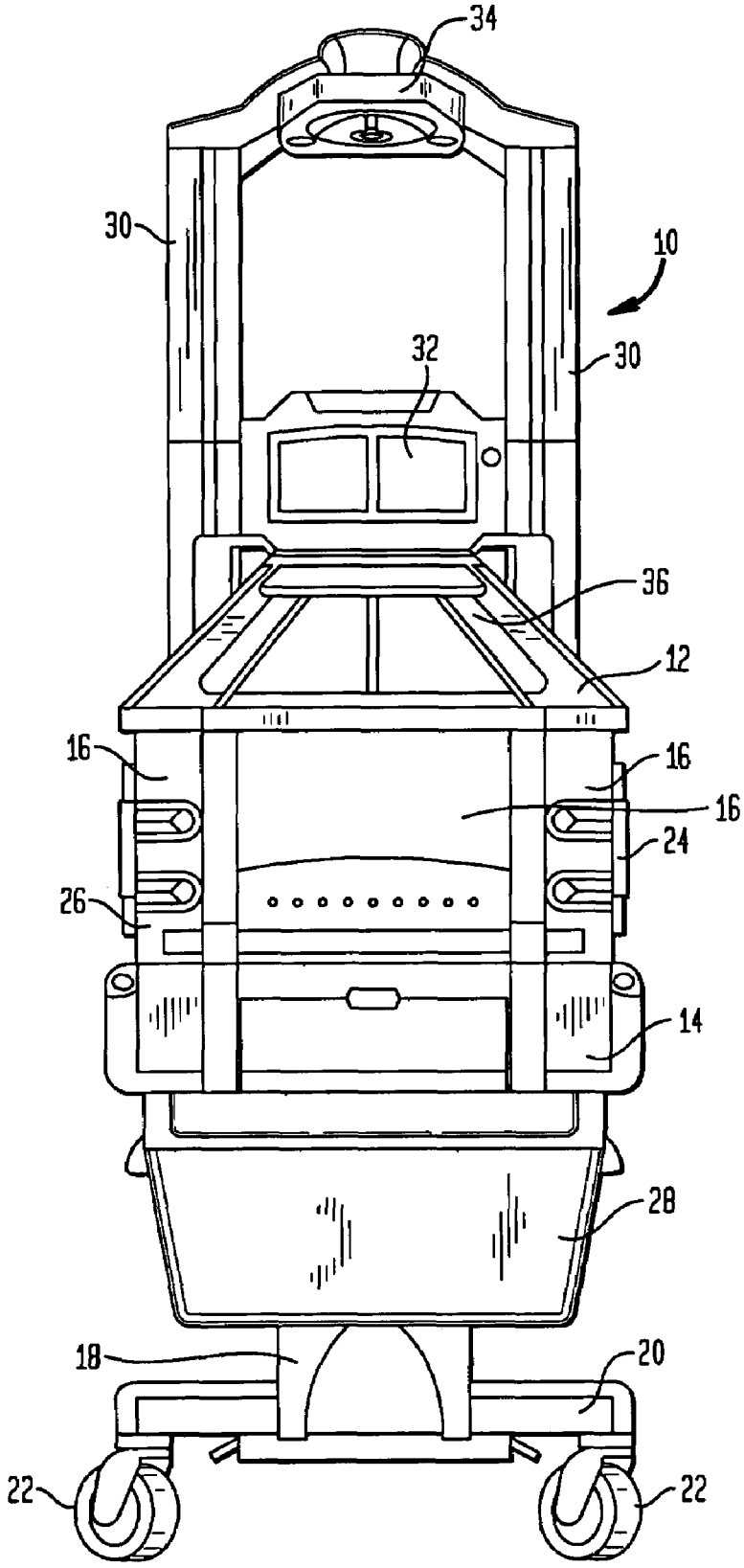
FIG. 1 is a front view of the infant warming apparatus constructed in accordance with the present invention with the canopy shown in its lower position.
Figure 2:
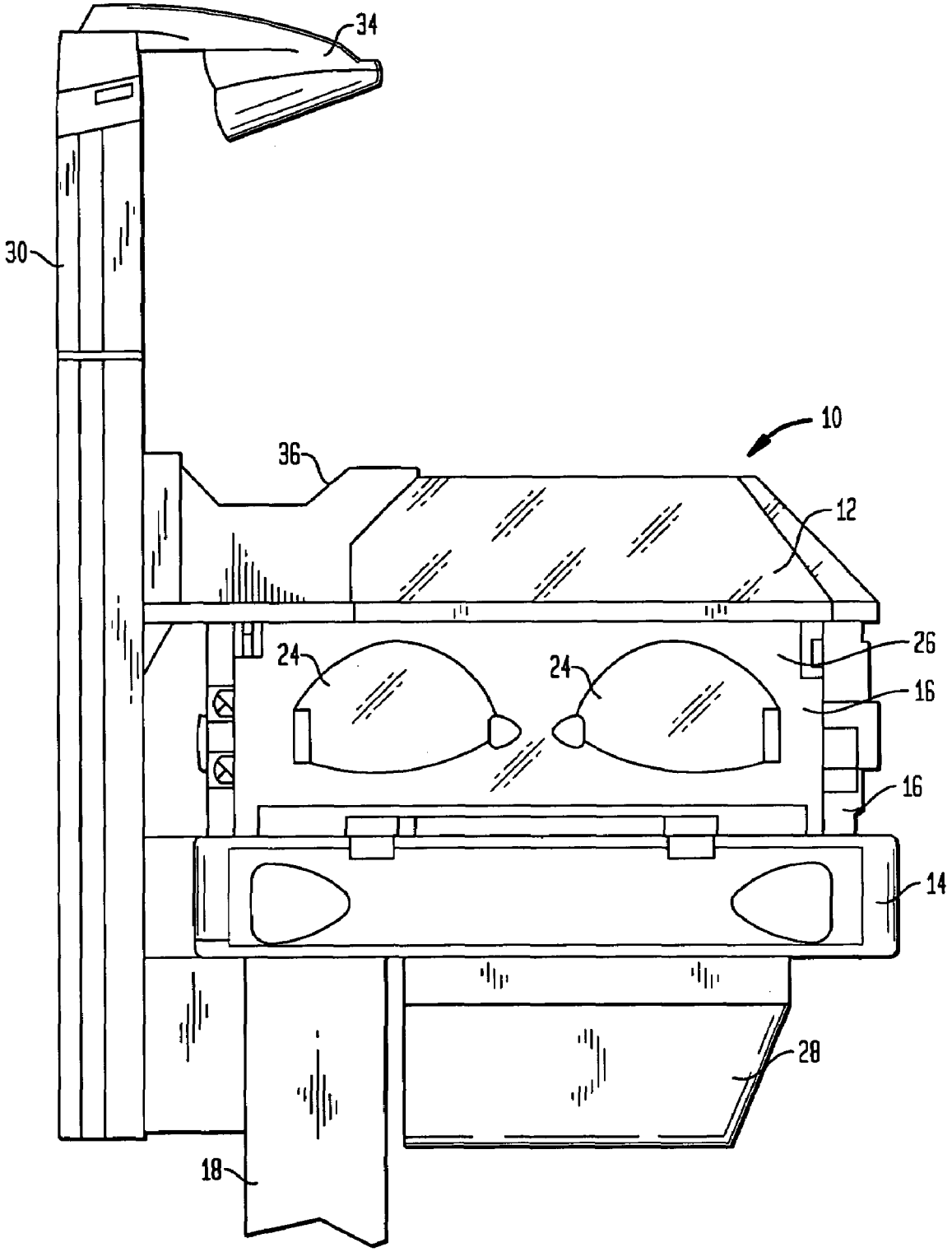
FIG. 2 is a side view of the infant warming apparatus of FIG. 1 with the canopy shown in its lower position.

Referring now to FIGS. 1 and 2, there is shown a front view and a side view, respectively, of an infant warming apparatus 10 constructed in accordance with the present invention with the canopy 12 in its lower position. As will be understood, in FIGS. 1 and 2, the canopy 12 is shown in its lower position wherein the infant warming apparatus 10 acts as an infant incubator with relatively limited access to the infant, as compared to an infant warmer, but with a very controlled environment where the temperature and possibly the humidity and/or oxygen concentration is established and carefully maintained for the wellbeing of the infant.

As shown, the infant warming apparatus 10 includes an infant support 14 that underlies and supports an infant. As is also seen, a plurality of walls 16 are provided to contain the infant safely within the infant warming apparatus 10 and are located at all of the four sides of the infant support 14. The walls 16 are preferable constructed of transparent plastic material and, as will be explained, cooperate with other components in order to provide an incubator function to the infant warming apparatus 10 when in the FIGS. 1 and 2 configuration.

The convective heating system that can be used with the present invention can be a well known and commercially used forced air convective system and one such system that can be used is shown and described in the aforementioned U.S. Pat. No. 6,213,936 of Mackin et al and the necessary apparatus for the convection heating system, such as the heater, fan, humidity control, air ducts and the like are normally located within the infant support 14. That convective heating system then circulates the heated air through the infant compartment that is formed when the present canopy 12 is in its lower position and the infant warming apparatus 10 is carrying out the function of an incubator.

The infant support 14 is mounted to a vertical base member 18 which, in the preferred embodiment, is movably affixed to a stationary vertical base member (not shown), which, in turn, is mounted to a base 20 having wheels 22 for ready movement of the infant warming apparatus 10.

The vertical base member 18 is preferably mounted so that the user can adjust the height of the infant support 14 by raising and lowering the vertical base member 18 as desired, thus the infant support 14 can be adjusted to the preferred height by the user. As further standard features, the walls 16 have handholes 24 to afford access to the infant when in the incubator configuration of FIGS. 1 and 2, and which generally have doors 26, or the walls themselves act as doors, that can be opened to obtain access to the infant and, of course, closed when the particular intervention has been completed to preserve the desired environment surrounding the infant.

Another convenient feature includes a drawer 28 to retain supplies or other devices needed to carry out some operation on the infant and which is normally located beneath the infant support 14. Other features include the maneuverability of the walls 16 that are pivotally mounted at their bases to the infant support 14 such that the doors can be swung outwardly and downwardly and, as a further alternative, can be easily fully removed from the infant support 14. As such, therefore, when the canopy 12 of the infant warming apparatus 10 is in its lower position as shown in FIGS. 1 and 2, the walls 16 can be dropped downwardly or removed altogether so that the attending personnel can have access to an infant resting on the infant support 14 to perform interventions on that infant.

Further structural components of the infant warming apparatus 10 include vertical frame members 30 that are affixed to the base member 18 and, as shown, there are two vertical frame members 30 in the preferred embodiment although there may be only one or there may be further numbers of such members.

A control module 32 is conveniently positioned intermediate the vertical frame members 30 and may include displays of various monitored parameters as well as include the various controls for operation of the functions of the infant warming apparatus 10.

A radiant heater 34 is located atop of the vertical frame members 30 and is held there in a fixed position with respect to the infant support 14 so that the radiant heater 34 can always be focused so as to direct the infrared energy toward an infant that is located on the infant support 14. Finally, with respect to FIGS. 1 and 2, there is an opening 36 in the upper surface of the canopy 12 of predetermined dimensions and location and the purpose of the opening 36 will later be explained.

Figure 3:
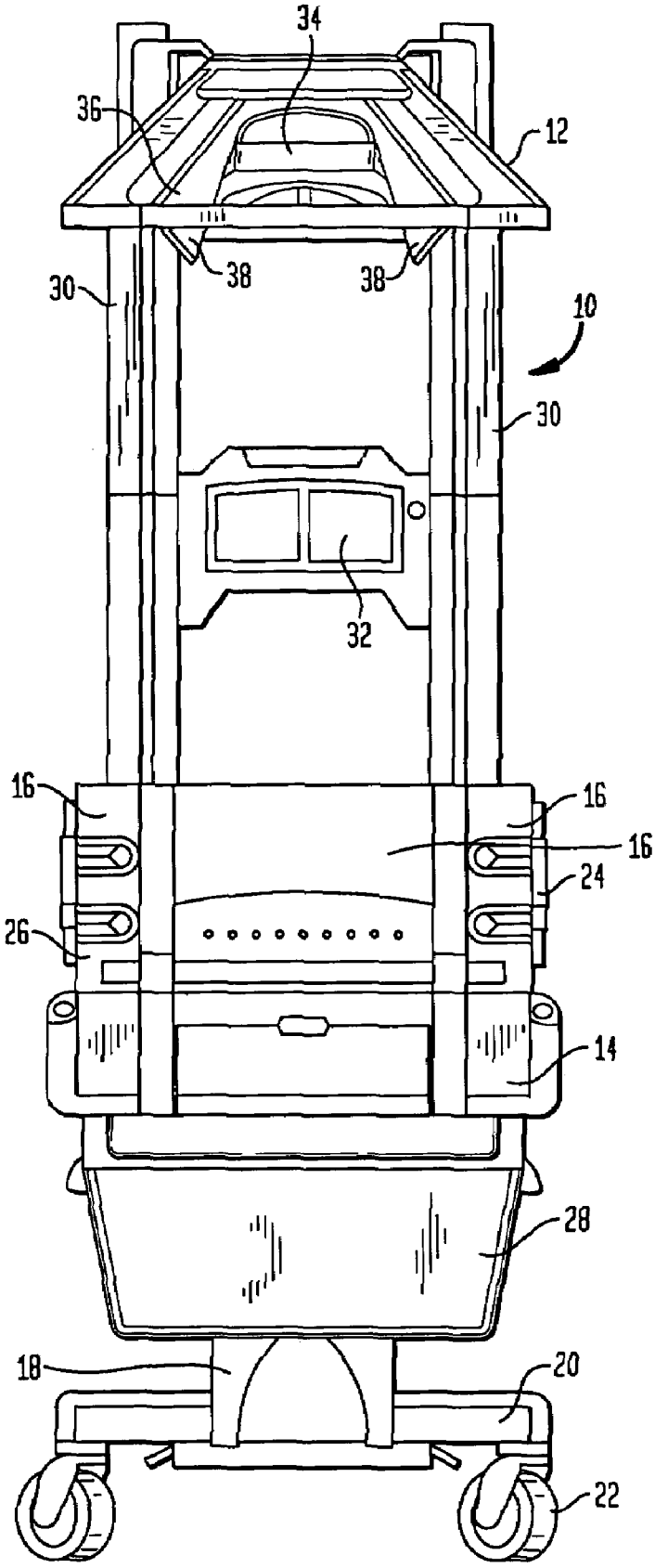
FIG. 3 is a front view of the present infant warming apparatus with the canopy shown in its upper position.
Figure 4:
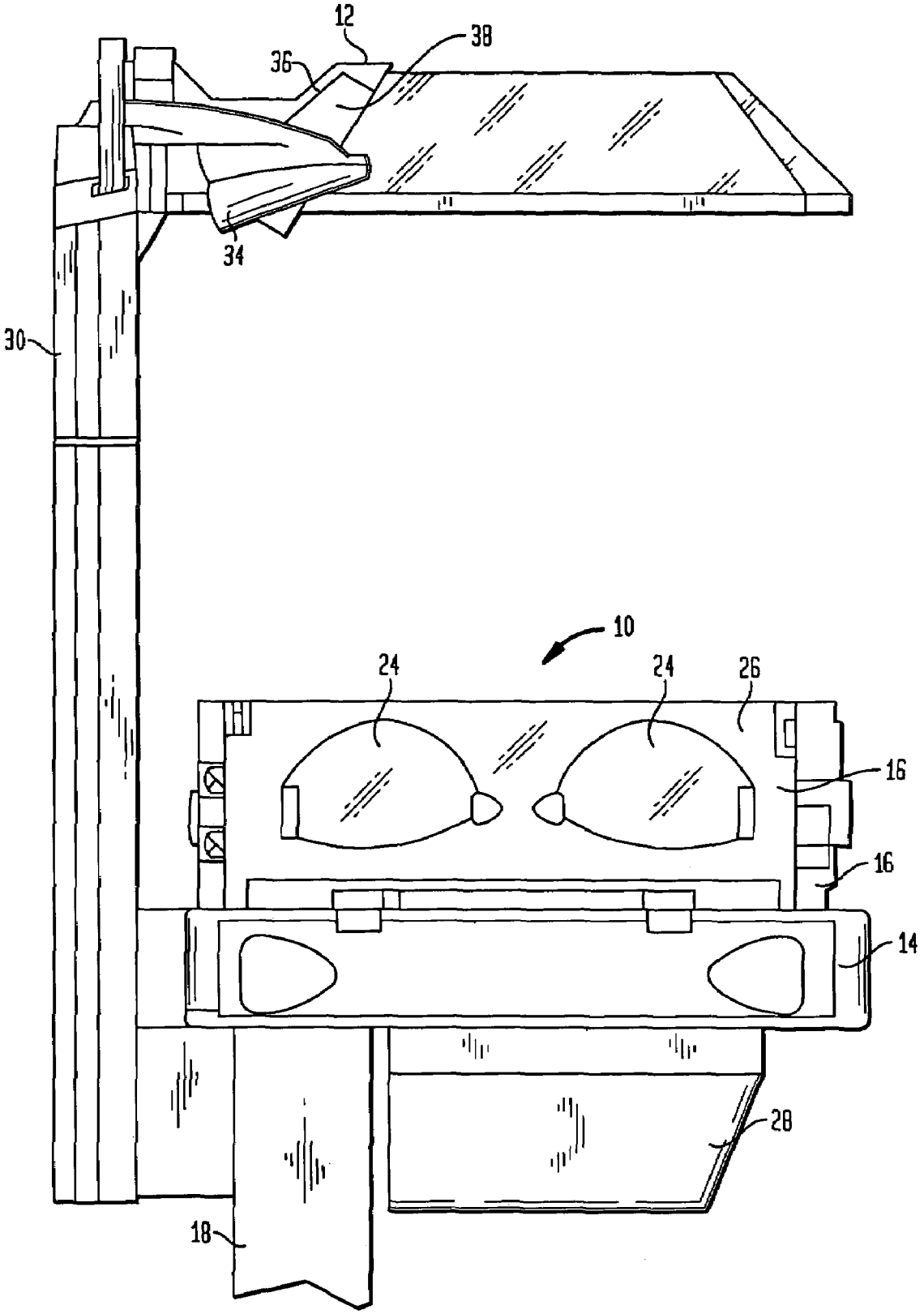
FIG. 4 is a side view of the infant warming apparatus of the present invention with the canopy shown in its upper position.

Turning now to FIGS. 3 and 4, there is shown a front view and a side view, respectively, of a infant warming apparatus 10 constructed in accordance with the present invention and where the canopy 12 is illustrated in its upper position. As stated, with the canopy 12 in that upper position, the infant care apparatus 10 functions as an infant warmer where there is full access to the infant and where the overhead radiant warmer 34 supplies heat to maintain the infant with sufficient warmth whereas, in the lower position of FIGS. 1 and 2, the infant warming apparatus 10 functions as a normal incubator, since the outer periphery of the infant canopy 12 fits fully over the upper edges of the walls 16 to form therein, an infant compartment that is provided with warm air and a controlled environment in the normal functioning of an incubator.

As may now be seen in general, the canopy 12 can be moved between its lower position as shown in FIGS. 1 and 2 to its upper position as shown in FIGS. 3 and 4 depending upon the mode of operation desired by the user. The elevating and lowering system that can be used to carry out the movement of the canopy 12 between those positions can be the system shown and described in U.S. Pat. No. 6,231,499 of Thomas C. Jones and entitled "Lift Mechanism For Infant Apparatus Canopy" however, any of a variety of other systems can be used to raise and lower the canopy 12 to achieve the results of the present invention.

As also can be seen in FIGS. 3 and 4, the opening 36 that is formed in the canopy 12 is dimensioned and located such that as the canopy 12 moves vertically from its lower position to its upper position, the opening 36 remains aligned with the radiant heater 34 such that when the radiant heater 34 is energized with the canopy 12 in its upper position, the radiant energy can pass directly, that is, unobstructed, from that radiant heater 34 through the opening 36 in a focused path to impinge upon the infant support 14.

Accordingly, the canopy 12 can be located in its upper position thereby allowing unlimited access to the infant to perform interventions on the infant, and yet the radiant heater 36 can serve its purpose of providing heat to the infant resting on the infant support 14. By the specific location and dimensions of the opening 36, the canopy 12 can be raised vertically with respect to the infant support 14, in converting the apparatus from an infant incubator to an infant warmer function yet the radiant heater 34 can remain fixed since the opening 36 in the canopy 12 allows the radiation from that radiant heater 34 to actually pass through the canopy 12.

As a further feature of the infant warming apparatus 10, in the preferred embodiment, there is a blocking member, preferably at least one door, and more preferably two doors 38 that are located intermediate the radiant heater 34 and the infant support 14. As shown in FIGS. 3 and 4, the doors 38 are in the open position so that the opening 36 allows the radiant energy to pass therethrough as if the doors 38 were not present.

Figure 5:
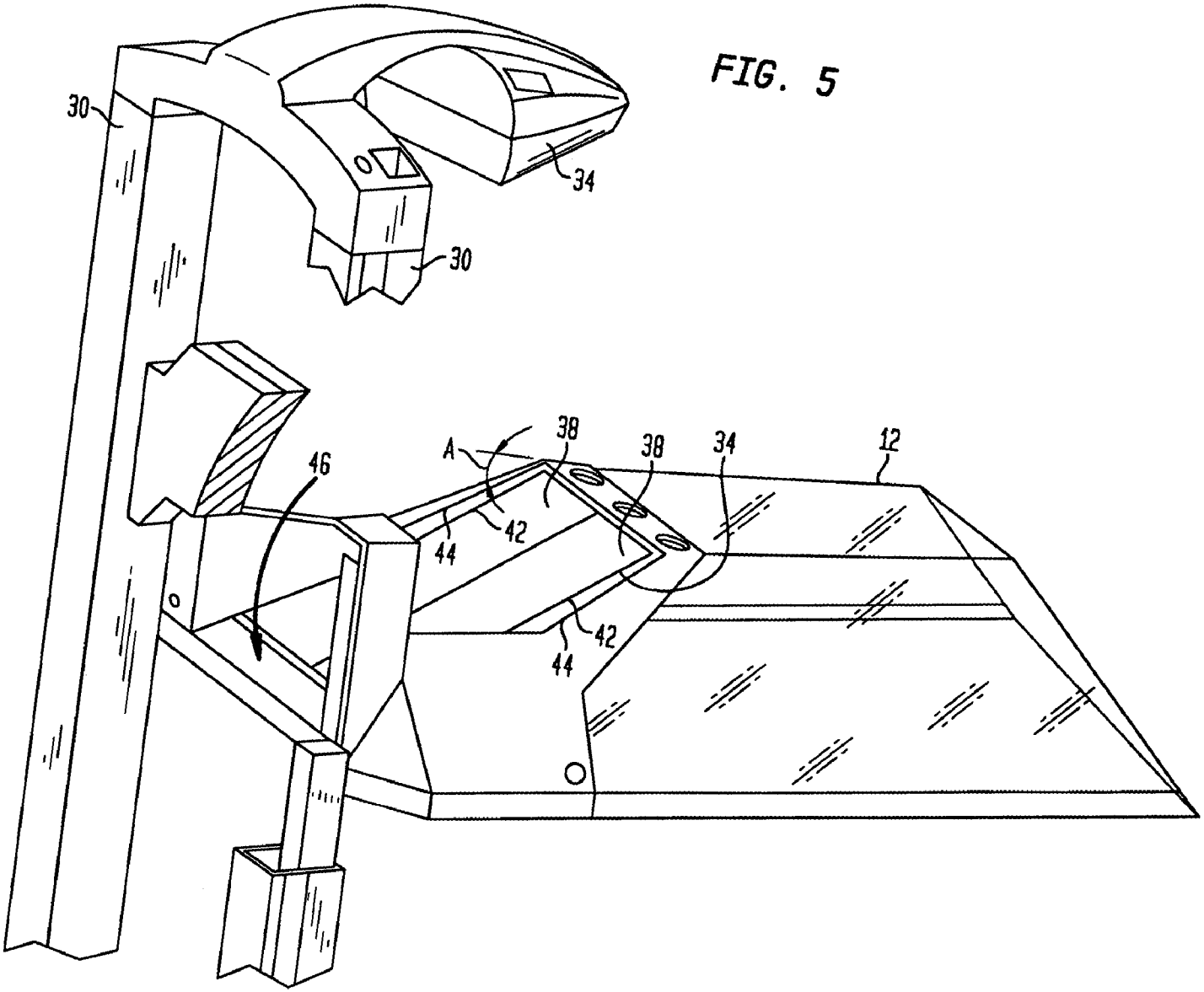
FIG. 5 is perspective view, partially cutaway, of the infant warming apparatus showing the canopy in an intermediate position.

In FIG. 5 there is a perspective view, partially cut away, with the canopy 12 in an intermediate position and with the doors 38 in the closed position, and thus closing the opening 36 so that the environment within which the infant is located can be controlled with the opening 36 that would otherwise affect the heat balance by allowing a large contact with the external environment. The doors 38 can be seen to both be pivotally affixed to the canopy 12 by means such as hinges 40 located at the outer edge 42 of each of the doors 38. In addition, the doors are biased toward their closed position of FIG. 5 by any conventional method, and one such method may be by means such as springs 44, shown schematically, so that the doors 38 will normally remain in the closed position. Alternatively, of course, the doors may have counterweights that bias them toward the closed position.

As also can be noted in FIG. 5, however, the doors 38 are oriented to be sloping downward in the direction outwardly of the canopy 12 such that there is an unobstructed path formed by the sloped doors 38 all the way to the rear edge 44 of the canopy 12 such that any object that is inadvertently placed on the doors 38 will naturally follow the down slope along the unobstructed surface to the rear edge 44 where the object will fall off of the doors 38 so that such objects do not remain on the upper surface of the doors 38 where they could become an impediment in the function of the door opening.

Preferably the angle of the doors 38 is sufficiently steep to cause such items to slide away for the center of the canopy 12 and that angle can be from about 20 degrees to about 50 degrees with respect to a horizontal plane and the angle is indicated on FIG. 5 as angle A and the angle is preferably about 30 degrees with respect to the horizontal plane passing through the canopy 12.

Thus, the present invention allows the use of a fixed overhead radiant heater 34 that can provide radiant energy to the infant when the infant care apparatus is acting as an infant warmer and yet have the advantage of an incubator by closing the opening 36 by the doors 38 to provide a protective environment when the infant care apparatus 10 is acting as an incubator.

Figure 6:
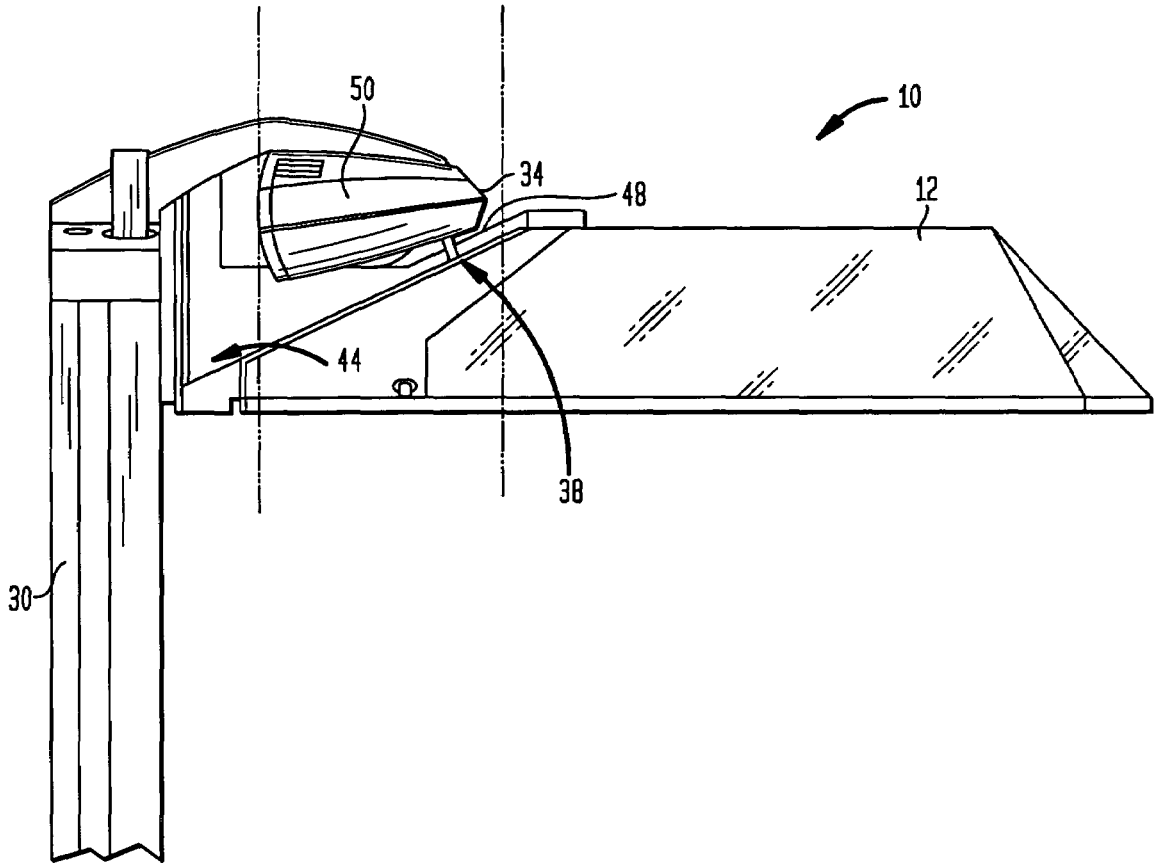
FIG. 6 is a side view of the present invention with the canopy approaching its upper position.
Figure 7:
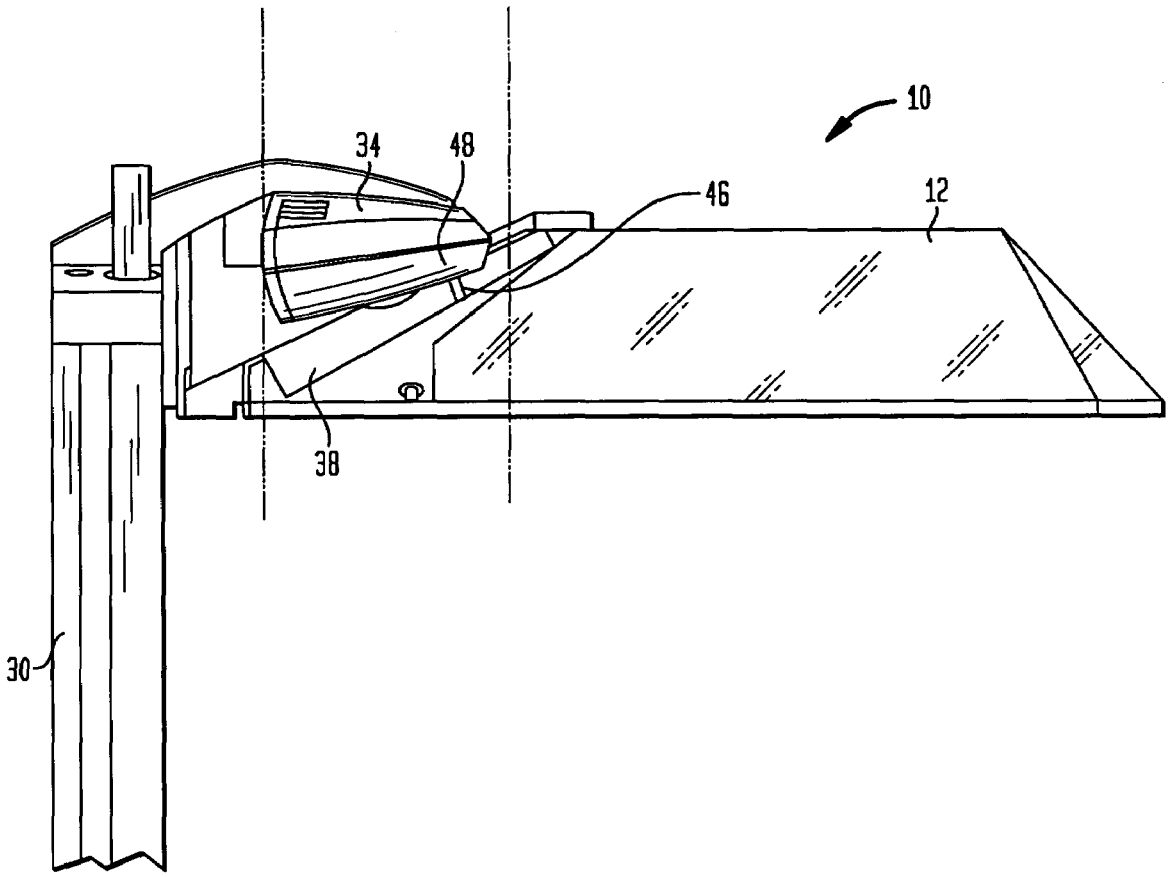
FIG. 7 is a side view of the present invention with the canopy further elevated than in the FIG. 6 illustration.
Figure 8:
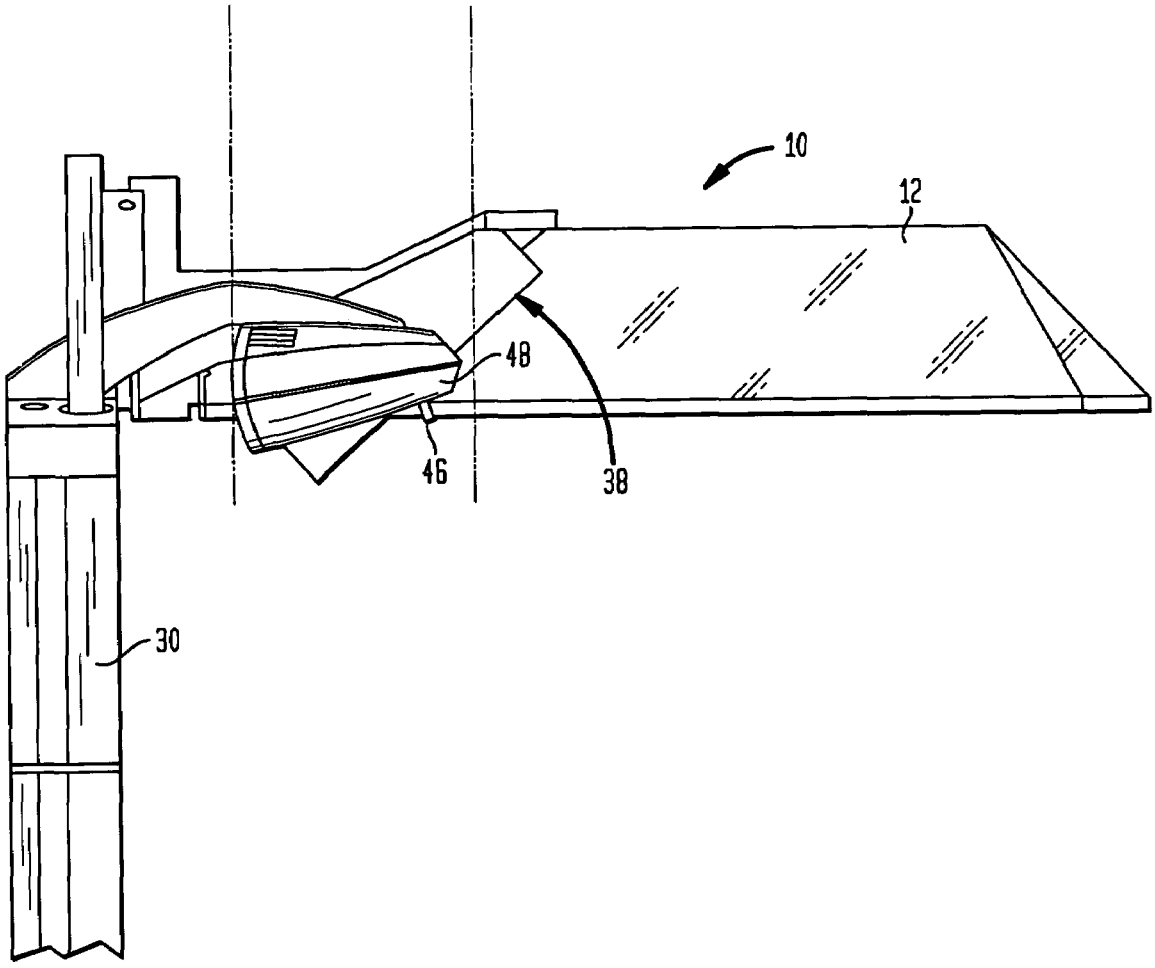
FIG. 8 is a side view of the present invention with the canopy fully raised to its upper position.

In FIGS. 6-8 there is shown a series of side views of the infant warming apparatus 10 that progressively show the opening of the doors 38 as the canopy 12 moves to its full upper position. Thus, in FIG. 6 there is a side view of the present infant warming apparatus 10 with the canopy 12 approaching its upper position. The doors 38 can be seen to be contacting a component of the radiant heater 34, in this case, that component is a curved bar 48 that is affixed to the housing 50 that makes up the radiant heater 34.

The curved bar 48 is a preferred and convenient component, however, it can be seen that any fixed component of the housing 50 or even a fixed member projecting out from one of both of the vertical frame members 30 can be used to encounter the upper surface of the doors 38, it only being of importance that the fixed component be fixed in position with respect to the infant support 14 so as to encounter the doors 38 of the vertically upwardly moving canopy 12. Other methods could, of course, be used to open and close the doors 38.

Accordingly, turning now to FIG. 7, there is a side view of the infant warming apparatus 10 showing a further upward movement of the canopy 12 such that the doors 38 have encountered the fixed component, in this case, the curved bar 48 and the doors 38 have, therefore, commenced opening by the force of the curved bar 48 exerting a downward force against the doors 38 countering and overcoming the bias that biases the doors 38 toward the closed position.

In FIG. 8, there is shown a side view of the infant warming apparatus 10 with the canopy 12 located in the full, upper position such that the doors 38 are fully open and the radiant heater 34 can be energized to direct the infrared energy downwardly through the opening 36 in the canopy 12 to provide warmth to the infant positioned on the infant support 14 (FIG. 1).

Figure 9:
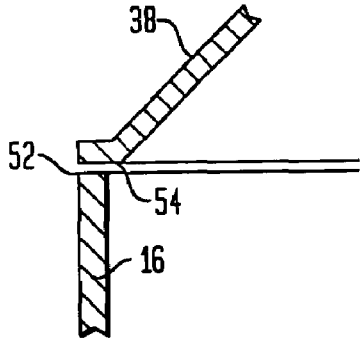
FIG. 9 is an enlarged side view showing the interaction between the canopy and the rear side walls of the present invention.

In FIG. 9, there is an enlarged side view of the mating of the door 38 with the upper edge 52 of the rear wall 16 and, as can be seen, there is a generally horizontal lower edge 53 of the door 38 that sits atop of the upper edge 52 of the rear wall 16 when the canopy 12 is in its lower position and thereby locks the door 38 in the closed position, it being unable to move downwardly to the open position by the interference with the door 38 by the upper edge 52 of the rear wall 16.

While the use of the upper edge 52 of the rear wall 16 is preferred, it can be seen that other devices, such as a projection extending inwardly from the rear wall 16 could be used to engage the lower surface of the door 38 to prevent the doors 38 from opening downwardly when the canopy 12 is in the lower position. Accordingly, if some object is inadvertently placed on the sloped surface of the doors 38 when the canopy is in its lower position and the object does not slide off the doors 38 by the downward slope angle of the doors 38, the locking means of the doors 38 abutting against the wall 16, or by the use of a projection prevents the weight of the object to cause the doors 38 to open and allow the object to fall into the infant compartment.

Figure 10A:
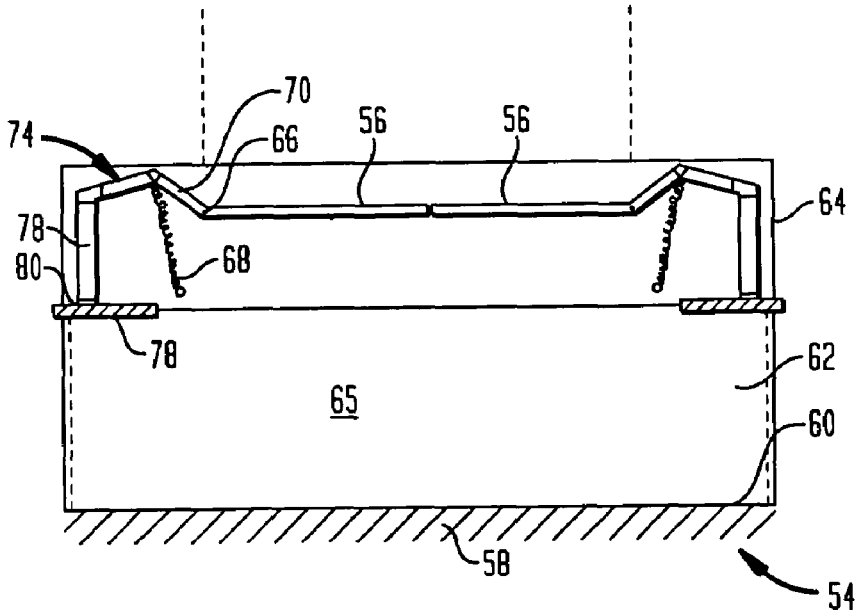
FIGS. 10A and 10B are schematic views of an alternative embodiment of the present invention and showing the doors in the closed position.
Figure 10B:
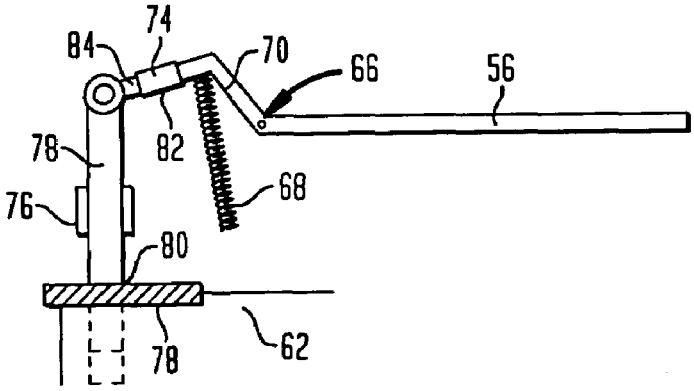

Turning now to FIGS. 10A and 10B, there is shown schematic views of an alternative embodiment of the present invention, and where FIG. 10A is an overall view of an infant warming apparatus 54 whereas FIG. 10B is an enlarged view of a mechanism to operate the doors 56 of that infant care apparatus. Since the FIGS. 10A and 10B embodiment are illustrated in schematic views, considerable details of the infant warming apparatus 54 are not illustrated, it being seen that the infant warming apparatus 54 can be basically the same as in the prior embodiment and having the same features and components.

Therefore, the infant warming apparatus 54 of FIGS. 10A and 10B can comprise a base 58, an infant platform 60 upon which the infant lies and transparent side walls 62 that are affixed to the base 58 to allow access to the infant by the caregiver.

As with the prior embodiment, there is a canopy 64 located above the base 58 and which, in its lower position illustrated in FIGS. 10A and 10B, forms an enclosed infant compartment 65 over the infant platform 60 to provide the protective environment for an infant. Since the mechanism of both doors 56 is basically the same, reference will be made to only one of the doors 56 where that door 56 is pivoted about a pivot point 66 so that the doors 56 can pivot as they move between their open and closed positions.

The door 56 is biased toward the open position, thus away from the position shown in FIGS. 10A and 10B by means such as spring 68 that acts at the end of a bracket 70 affixed to the door 56. As such, the door 56 pivots about its pivot point 66 from the closed position of FIGS. 10A and 10B to its open position and is biased by the spring 68 toward that open position as will be later described.

A pin 72 extends vertically downward from the canopy 64 and that pin 72 is affixed to the bracket 70 through a linkage 74. Basically, the pin 72 is located and mounted in a vertically oriented channel formed in the canopy 64 such that the pin 72 can move along a vertically path so as to move the linkage 74 and, as will be seen, also move the door 56 about its pivot point 66. In short, the vertical movement of the pin 72 causes the door 56 to rotate about the pivot point 66.

The mechanism for the movement of that door 56 is best illustrated in FIG. 10B where the vertically oriented channel 76 can be seen that restrains the movement of the pin 72 to a vertical movement along the longitudinal axis of the pin 72. Thus, as can be seen in FIG. 10B, taken along with FIG. 10A, the spring 68 maintains a bias against the door 56 to bias the door 56 toward its open position, that is, the door 56 whould, but for the mechanism to be described, spring open by means of the spring 68

In addition, as seen in FIG. 10B, the pin 72 has bottomed out on a closing block 78 that is located atop of a side wall 62. The closing block 78 is, therefore, in a fixed location with respect to the infant warming apparatus 54 and, of course, fixed with respect to the vertically movable canopy 64. As such, when the canopy 64 is lowered from its upper position to its lower position, the lower end 80 of the pin 72 encounters the fixed closing block 78 and which blocks the further downward movement of the pin 72.

Therefore, as the canopy 64 continues to move downwardly, the pin 72, now blocked against such the downward movement, basically pushes vertically upwardly to act on the linkage 74 to move that linkage 74 upwardly along with the bracket 70 to move the door 56 to its closed position, as shown, against the bias exerted by the spring 68. The position of the pin 72 is, therefore, in its vertically uppermost position in FIGS. 10A and 10B.

As also can be seen in the schematic view of FIG. 10B, the linkage 74 has an adjustment means to change its overall length so that the door 56 can be adjusted to fully close when the canopy 64 is properly positioned in its lower position against the side walls 62 (FIG. 10A). That length adjustment of the linkage 74 may be by a number of differing means, however, one convenient and simple means can be by the use of a turnbuckle 82 that is affixed to a threaded shaft 84 so that a simple rotation of the turnbuckle 82 can change the overall length of the linkage 74.

Figure 11B:
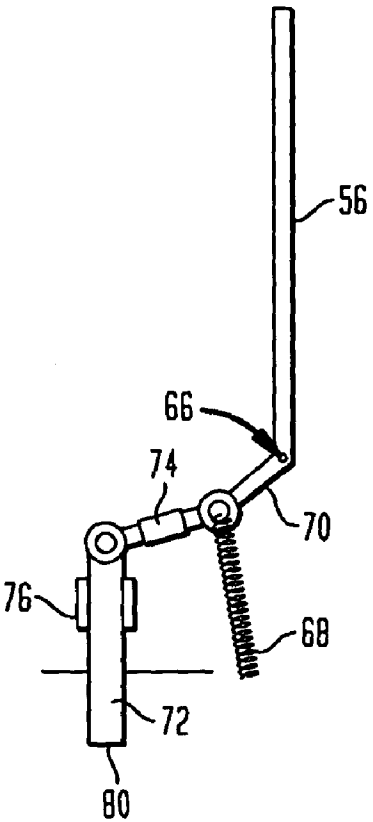
FIGS. 11A and 11B are schematic views of the embodiment of FIGS. 10A and 10B with the doors in the open position.
Figure 11A:
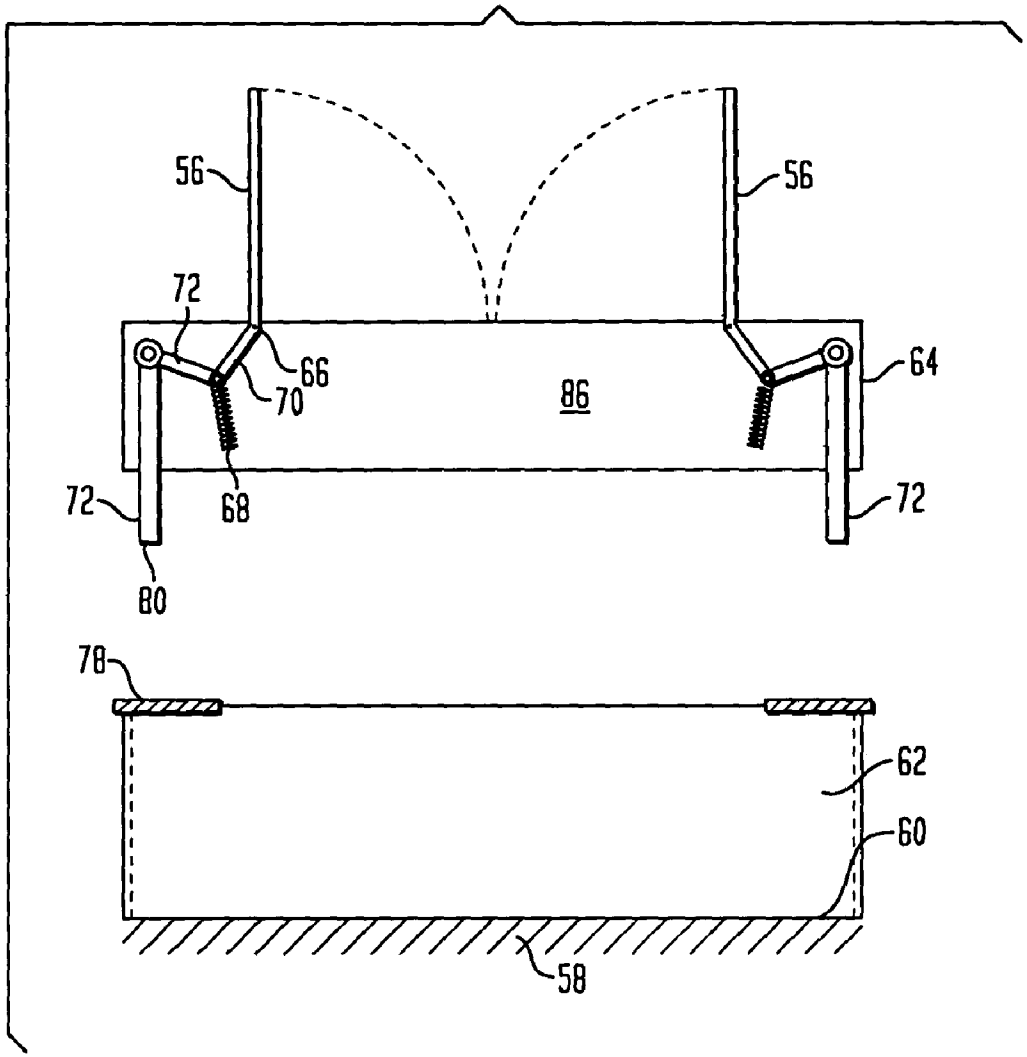

Turning now to FIGS. 11A and 11B, there is shown the infant warming apparatus 54 of FIGS. 10A and 10B but where the canopy 64 has been raised from its lower position as shown in FIGS. 10A and 10B to its upper position as illustrated in FIGS. 11A and 11B.

Taking FIG. 11A first, it can be seen that the canopy 64 has been elevated with respect to the side walls 62 such that the pin 72 is free to extend downwardly to its normal biased position since the spring 68 pulls the linkage 74 and bracket 70 in the downward direction to open the door 56. Accordingly, as the canopy is raised from the lower position of FIGS. 10A and 10B, there is no longer a contact between the lower end 80 of the pin 72 and the closing block 78 so that the pin 72 is free to move vertically downward to its lowermost position of FIGS. 11A and 11B and the doors 56 move to their open position by means of the spring bias created by the spring 68.

The mechanism is more clearly shown in FIG. 11B where the pin 72 can be seen to have moved, constrained by the vertically oriented channel 76, to its lowermost position and the bias of the spring 68 has caused the door 56 to open. Thus, when the canopy 64 begins its normal ascent from its lower position to its upper position, as explained previously, the door 56 automatically opens so that when the canopy 64 reaches its upper position, the opening 86 in the canopy 64 can allow the radiant energy to pass from the infrared heater 34 (FIG. 1) to direct that infrared energy toward an infant resting on the infant platform 60.

Figure 12A:
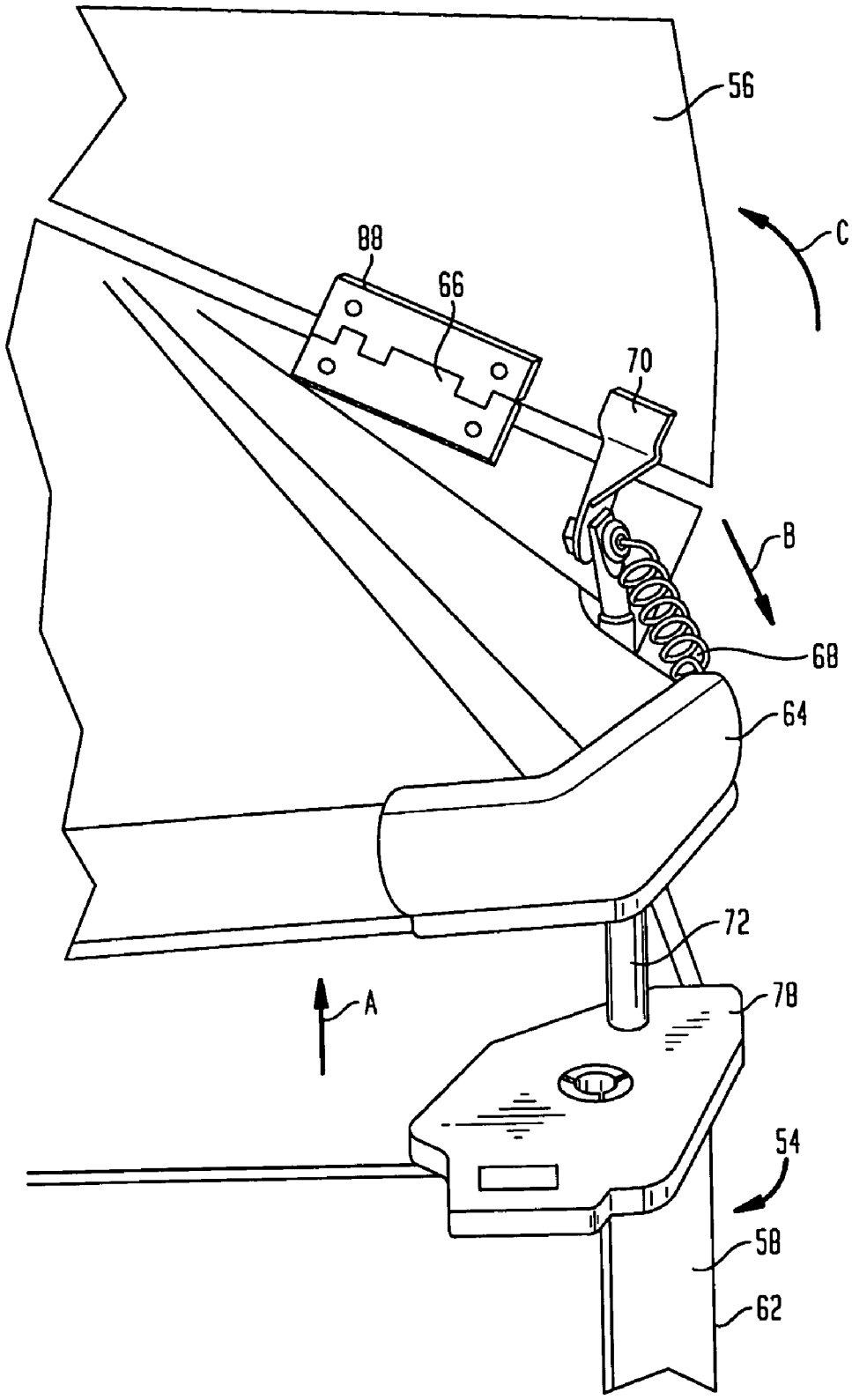
FIG. 12A is a schematic view of an infant warming apparatus showing a door moving towards its upper position.
Figure 12B:
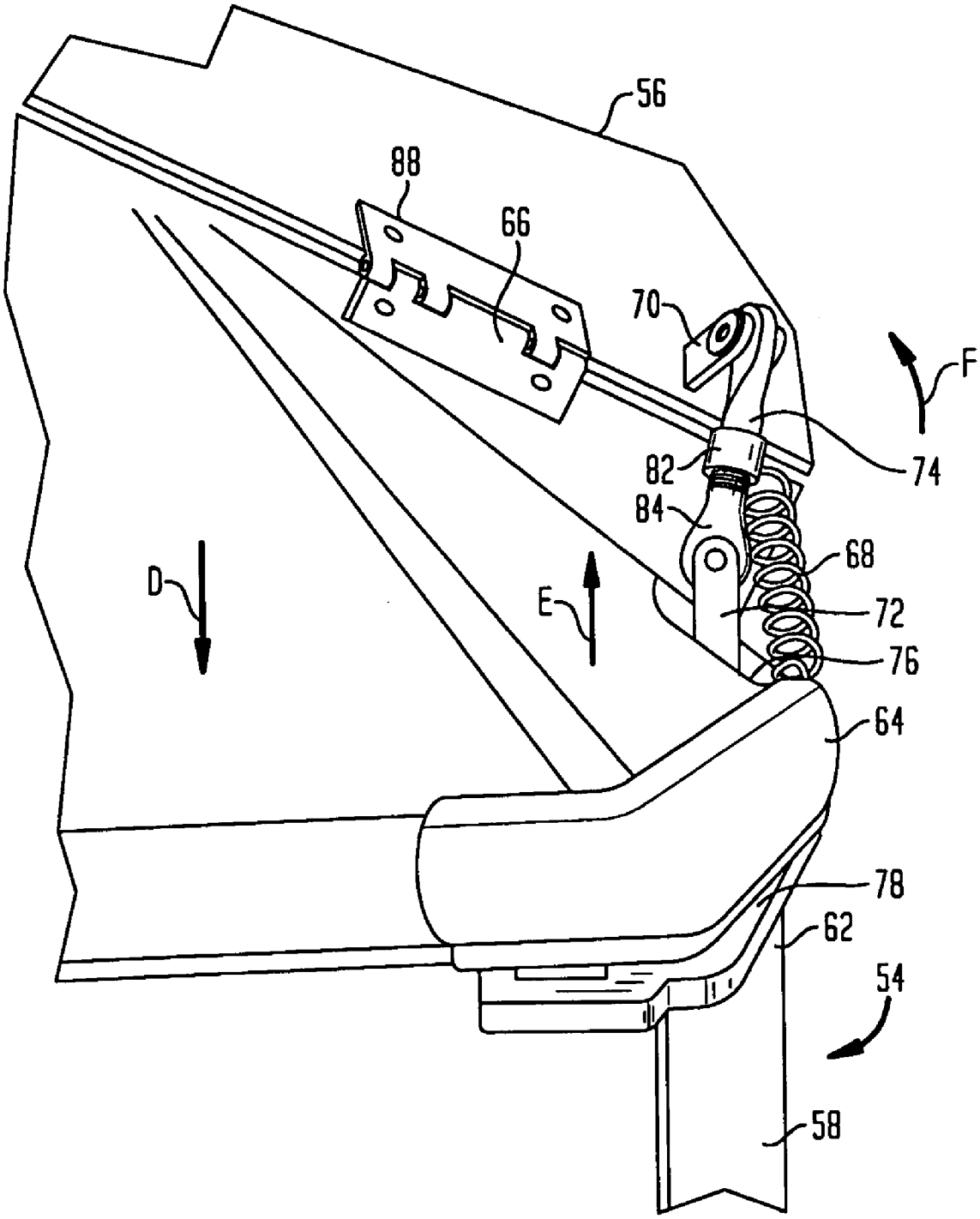
FIG. 12B is a schematic view of the infant warming apparatus of FIG. 12A with the canopy moving toward its lower position.

Finally, turning to FIGS. 12A and 12B, there is shown further schematic views of the infant warming apparatus 54 of the present invention and further illustrating the alternative embodiment as explained with respect to FIGS. 10A, 10B, 11A and 11B and the same reference numbers will be used for corresponding components and features where applicable. In FIG. 12A, the canopy 64 of the infant warming apparatus 54 is moving in the upward direction, that is, in the direction of the arrow A such that the pin 72 is in its lowermost position shown just touching or somewhat above the surface of the closing block 78.

As such, the spring 68 has exerted a bias against the bracket 70 and the linkage 74 to pull those component downwardly as shown by the arrow B and which, in turn, moves the door to its open position represented by the arrow C. Thus, as the canopy 64 of FIG. 12A is moving upwardly, the bias of the spring 68 is effective to move the door 56 to its open position so that, as explained, when the canopy 64 continues further vertically upward movement, the door 56 is fully open by the time the canopy 64 reaches its upper position and the radiant energy from the overhead radiant heater 34 (FIG. 1) can pass directly through the canopy 64 to impinge upon an infant resting upon the infant platform 60.

Turning then to FIG. 12B, it can be seen that the canopy 64 has been lowered to its lower position by movement in the direction of the arrow D. In that position, it can be seen that the pin 72 has been moved upwardly in the direction of the arrow E by contact with the closing block 78 and that the vertical movement of the pin 72 with respect to the canopy 64 has acted against the bias of the spring 68 to cause the linkage 74 as well as the bracket 70 to pivot the door 56 about the pivot point 66, shown as a hinge 88 to move the door 56 to its closed position as shown by the arrow F.

Accordingly, as the canopy 64 is moved to its lower position, wherein the infant warming apparatus 54 functions as an incubator, the door 56 or doors will automatically close by the result of the pin 72 moving with the canopy 64 and encountering a fixed component, that of the closing block 78 such the further downward movement of the canopy 64, in effect, causes the pin 72 to move upwardly with respect to the canopy 64 to move the door 56 to the closed position against the bias of spring 68.

As a further feature, in the case where the doors overlap, or for some other reason, it is desirable for the doors to be sequenced or staggered in arriving at their closed positions, the doors 56 can be sequenced closed simply by determining the length of the pin 72 that is actuating one of the doors, that is, the pin actuating one of the doors can be made shorter or longer than the other pin actuating the other door so that the ultimate closing of the respective doors can be staggered with respect to each other.

Those skilled in the art will readily recognize numerous adaptations and modifications which can be made to the infant care apparatus of the present invention which will result in an improved system, yet all of which will fall within the scope and spirit of the present invention as defined in the following claims. Accordingly, the invention is to be limited only by the following claims and their equivalents.

We claim:

1. An infant care apparatus, said apparatus comprising a base having an infant support on which an infant is adapted to be positioned, a radiant heater mounted to said base at a fixed vertical distance above said infant support, a canopy mounted to said base, said canopy being movable between a lower position wherein said canopy fits over said infant support to form an infant compartment adapted to enclose an infant and an upper position wherein said canopy is elevated with respect to said infant support and the infant compartment is open, said canopy having an opening formed therein located so as to be positioned between said radiant heater and said infant support when said canopy is in said upper position to allow said radiant heater to direct radiant energy through said opening toward said infant support.

2. An infant care apparatus as defined in claim 1 wherein said canopy has at least one door, said at least one door having a closed position blocking said opening when said canopy is in said lower position and an open position when said canopy is in said upper position, said door being openable or closable by interaction with a fixed component of said infant care apparatus as said canopy moves, respectively, from its lower position to its upper position and from its upper position to its lower position.

3. An infant care apparatus as defined in claim 2 wherein said at least one door is openable by interaction with a fixed component of the infant care apparatus as the canopy moves to said upper position.

4. An infant care apparatus as defined in claim 3 wherein the fixed component is affixed to or is the radiant heater.

5. An infant care apparatus as defined in claim 3 wherein the at least one door is biased toward its closed position.

6. An infant care apparatus as defined in claim 2 wherein said infant care apparatus further includes a locking mechanism to lock said at least one door in the closed position when in said lower position.

7. An infant care apparatus as defined in claim 6 wherein said locking mechanism comprises a projection that physically contacts said at least one door when said canopy is in said lower position to lock said at least one door in its closed position.

8. An infant care apparatus as defined in claim 6 wherein said at least one door comprises a pair of doors.

9. An infant care apparatus as defined in claim 2 said at least one door is closable by interaction with a the fixed component of the infant care apparatus as the canopy moves to said lower position.

10. An infant care apparatus as defined in claim 9 wherein said at least one door is biased toward its open position.

11. An infant care apparatus, said apparatus comprising a base having an infant support on which an infant is adapted to be positioned, a radiant heater mounted to said base at a fixed vertical distance above said infant support, a canopy mounted to said base, said canopy being movable between a lower position wherein said canopy fits over said infant support to form an infant compartment adapted to enclose an infant and an upper position wherein said canopy is elevated with respect to said infant support and the infant compartment is open, said canopy having an opening formed therein located so as to be positioned between said radiant heater and said infant support when said canopy is in said upper position to allow said radiant heater to direct radiant energy through said opening toward said infant support, said canopy having at least one door, said at least one door having a closed position blocking said opening when said canopy is in said lower position and an open position when said canopy is in said upper position, said door being biased toward said open position, said at least one door being closable by an interaction between said at least one door and a fixed member of the infant warming apparatus when said canopy moves from its upper position to said lower position.

12. An infant care apparatus as defined in claim 11 wherein said infant warming apparatus includes a mechanism to interact between said at least one door and a fixed member of the infant care apparatus.

13. An infant care apparatus as defined in claim 12 wherein said mechanism comprises a bracket affixed to said at least one door and a vertically oriented pin connected to said bracket and having a lower end that is adapted to contact the fixed member as said canopy moves toward said lower position to prevent further downward movement of said pin, whereby further downward movement of said canopy causes said pin to move said bracket against the bias to close said at least one door.

14. An infant care apparatus as defined in claim 13 wherein said pin is connected to said bracket by means of an intermediate linkage.

15. An infant care apparatus as defined in claim 14 wherein said linkage has a means to vary the length of the linkage.

16. An infant care apparatus as defined in claim 13 wherein said at least one door comprises a pair of doors, each having a mechanism including a pin and wherein a pin for one of the pair of doors is a different length than the pin for the other of the pair of doors.

17. An infant care apparatus as defined in claim 12 wherein there are a plurality of vertically oriented side walls forming the infant compartment and said canopy fits over the vertically oriented side walls when in said lower position, and wherein said fixed member is located atop of at least one of the vertically oriented side walls.

18. An infant care apparatus as defined in claim 12 where the bias on said at least one door is created by means of a spring having one end thereof affixed to the bracket or the linkage.

19. An infant care apparatus as defined in claim 18 wherein said at least one door comprise a pair of doors.

20. An infant care apparatus, said apparatus comprising a base having an infant support on which an infant is adapted to be positioned, a radiant heater mounted to said base at a fixed vertical distance above said infant support, a canopy mounted to said base, said canopy being movable between a lower position wherein said canopy fits over said infant support to form an infant compartment adapted to enclose an infant and an upper position wherein said canopy is elevated with respect to said infant support and the infant compartment is open, said canopy having an opening formed therein located so as to be positioned between said radiant heater and said infant support when said canopy is in said upper position to allow said radiant heater to direct radiant energy through said opening toward said infant support, at least one door mounted to said canopy, said at least one door having a closed position blocking said opening when said canopy is in said lower position and an open position when said canopy is in said upper position, said at least one door being oriented at a predetermined angle and forming, with said canopy, an unobstructed path along an upper surface of said at least one door when in the closed position to cause objects placed on the upper surface of said at least one door to move downwardly along the unobstructed surface to fall free of the upper surface of the at least one door.

21. An infant care apparatus as defined in claim 20 wherein said predetermined angle is between about 20 degrees and about 50 degrees.

22. An infant care apparatus as defined in claim 21 wherein said predetermined angle is about 30 degrees.

23. An infant care apparatus as defined in claim 20 wherein the at least one door comprise a pair of doors.

* * * * *